United States Patent [19]

Mick

[11] Patent Number: 4,557,390

[45] Date of Patent: Dec. 10, 1985

[54] SUSPENDED COUNTERWEIGHT CONTROL SYSTEM

[75] Inventor: Jon L. Mick, Cedar Rapids, Iowa

[73] Assignee: FMC Corporation, Chicago, Ill.

[21] Appl. No.: 528,685

[22] Filed: Sep. 1, 1983

[51] Int. Cl.[4] ..... B66C 23/76; B66C 13/06

[52] U.S. Cl. ..... 212/197; 212/148; 212/150; 212/232; 254/291; 414/719

[58] Field of Search ..... 212/146, 148, 149, 150, 212/153, 152, 155, 156, 158, 159, 191, 195, 196, 197; 340/685, 522; 73/862.56; 414/560–563, 601–602, 673, 687, 719; 254/278, 290–292

[56] References Cited

U.S. PATENT DOCUMENTS

| | | | |
|---|---|---|---|
| 315,109 | 4/1885 | Ball . | |
| 524,619 | 8/1894 | Sturm . | |
| 701,887 | 6/1902 | Jackson . | |
| 1,344,659 | 6/1920 | Sjoberg . | |
| 2,130,487 | 9/1938 | Folley | 212/196 |
| 2,408,500 | 10/1946 | West | 212/49 |
| 3,202,299 | 8/1965 | DeCuir | 212/59 |
| 3,209,920 | 10/1965 | DeCuir | 212/58 |
| 3,240,353 | 3/1966 | Leavesley | 212/156 |
| 3,485,383 | 12/1969 | Beduhn | 212/48 |
| 3,501,021 | 3/1970 | Schreier et al. | 414/719 |
| 3,921,815 | 11/1975 | Brown et al. | 212/3 |
| 3,965,841 | 6/1976 | Croese | 254/291 |
| 3,977,531 | 8/1976 | Brewer | 212/59 |
| 4,170,309 | 10/1979 | Lampson | 212/48 |
| 4,243,148 | 6/1981 | Lampson | 212/196 |
| 4,258,852 | 3/1981 | Juergens | 212/197 |
| 4,280,627 | 7/1981 | Becker | 212/197 |
| 4,360,111 | 11/1982 | Weiskopf | 212/196 |

FOREIGN PATENT DOCUMENTS

| | | | |
|---|---|---|---|
| 936754 | 2/1948 | France . | |
| 221737 | 10/1981 | German Democratic Rep. | 212/197 |
| 126889 | 6/1927 | Switzerland | 212/154 |
| 1031022 | 5/1966 | United Kingdom | 212/147 |
| 1220049 | 1/1971 | United Kingdom | 212/156 |
| 368170 | 3/1973 | U.S.S.R. | 212/150 |
| 380799 | 8/1973 | U.S.S.R. | 414/719 |

*Primary Examiner*—Trygve M. Blix
*Assistant Examiner*—R. B. Johnson
*Attorney, Agent, or Firm*—A. J. Moore; H. M. Stanley; R. B. Megley

[57] ABSTRACT

An apparatus is disclosed for counterbalancing a load carried by a crane by a counterweight suspended from the mast of the crane. A counterweight height control system is provided for maintaining the counterweight a few inches above the ground during operation, which system may be manually overridden by operator actuated controls. A pair of spaced counterweight positioning winches on opposite sides of the longitudinal axis of the crane's upper works move the counterweight toward or away from the vertical axis of rotation of the upper works in response to operator actuated controls and also provides side forces on the counterweight for minimizing swinging of the counterweight.

1 Claim, 5 Drawing Figures

FIG_2
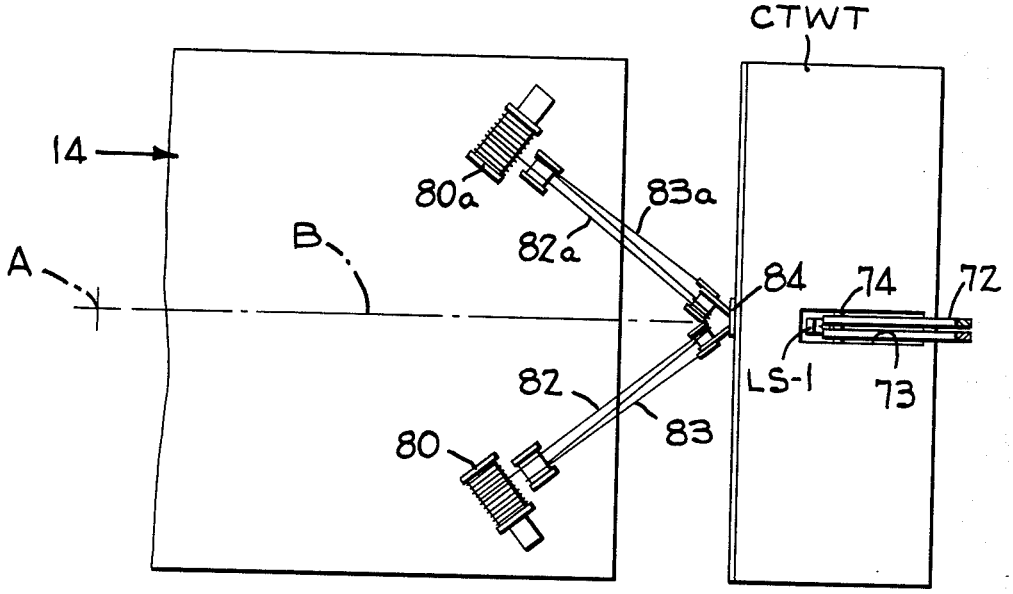
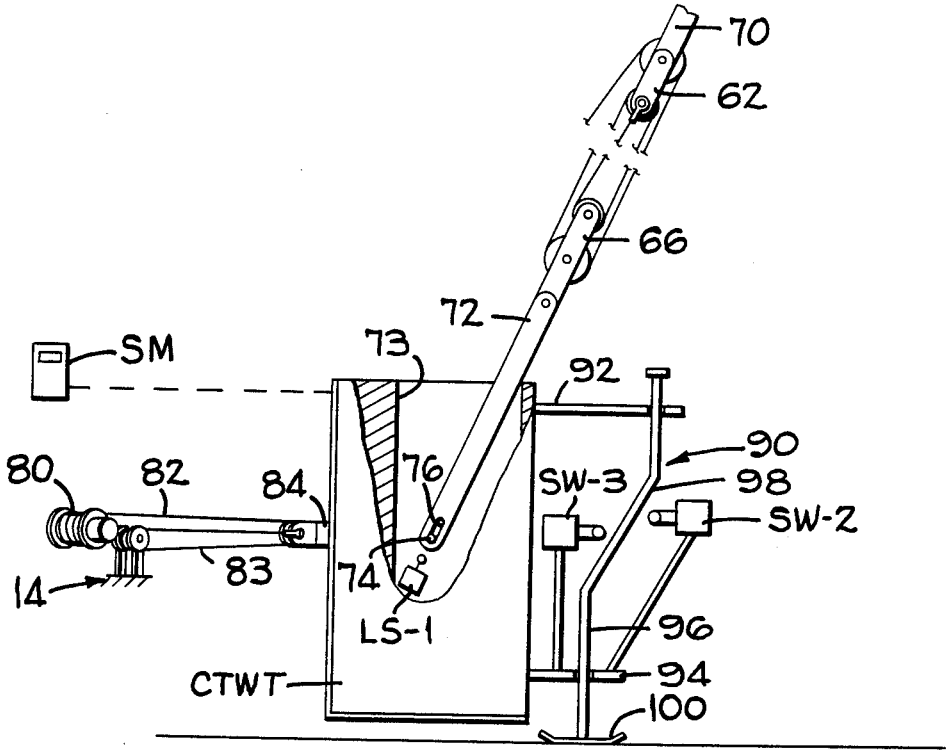
FIG_3

SUSPENDED COUNTERWEIGHT CONTROL SYSTEM

CROSS REFERENCE TO RELATED APPLICATION

The present invention is pertinent to the invention disclosed in Jones et al application Ser. No. 528,686 entitled Floating Counterweight Crane filed on even date herewith now abandoned. The disclosure of said application is incorporated by reference herein.

BACKGROUND OF THE INVENTION

1. Field of the Invention

The present invention relates to cranes or the like and more particularly relates to travel cranes having counterweights which may be adjusted toward or away from the load during lifting and travel, and which will be stabilized while swinging about a vertical axis.

2. Description of the Prior Art

Mobile cranes with counterweights suspended therefrom are known in the art as evidenced by DeCuir U.S. Pat. Nos. 3,202,299 and 3,209,920; and Foley U.S. Pat. No. 2,130,487 which issued on Sept. 20, 1938.

SUMMARY OF THE INVENTION

The suspended counterweight control system of the present invention is associated with a travel crane having a counterweight suspended from a mast and movable toward and away from the vertical swing axis of the crane. A pair of diagonally oriented winches on opposite sides of the longitudinal axis of the crane's upper works are attached to the counterweight and apply evenly balanced pulling forces against the counterweight outwardly away from the longitudinal axis thereby balancing the load suspended from the boom and stabilizing the counterweight from swinging movement relative to said longitudinal axis. In order to minimize turnover tendencies due to loss of load or the like, height control means are provided on the crane for maintaining the counterweight a short distance above the ground during operation.

BRIEF DESCRIPTION OF THE DRAWINGS

FIG. 2 is a diagrammatic plan of the rear portion of the upper works illustrating a pair of diagonal winches connected to the counterweight for maintaining the counterweight centered during operation.

FIG. 3 is a diagrammatic side elevation of the counterweight illustrating one of the diagonal winches and a height control means for the counterweight, a portion of the counterweight being cut away and the dimensions of the height control mechanism being greatly exaggerated.

DESCRIPTION OF THE PREFERRED EMBODIMENT

Figure 1:
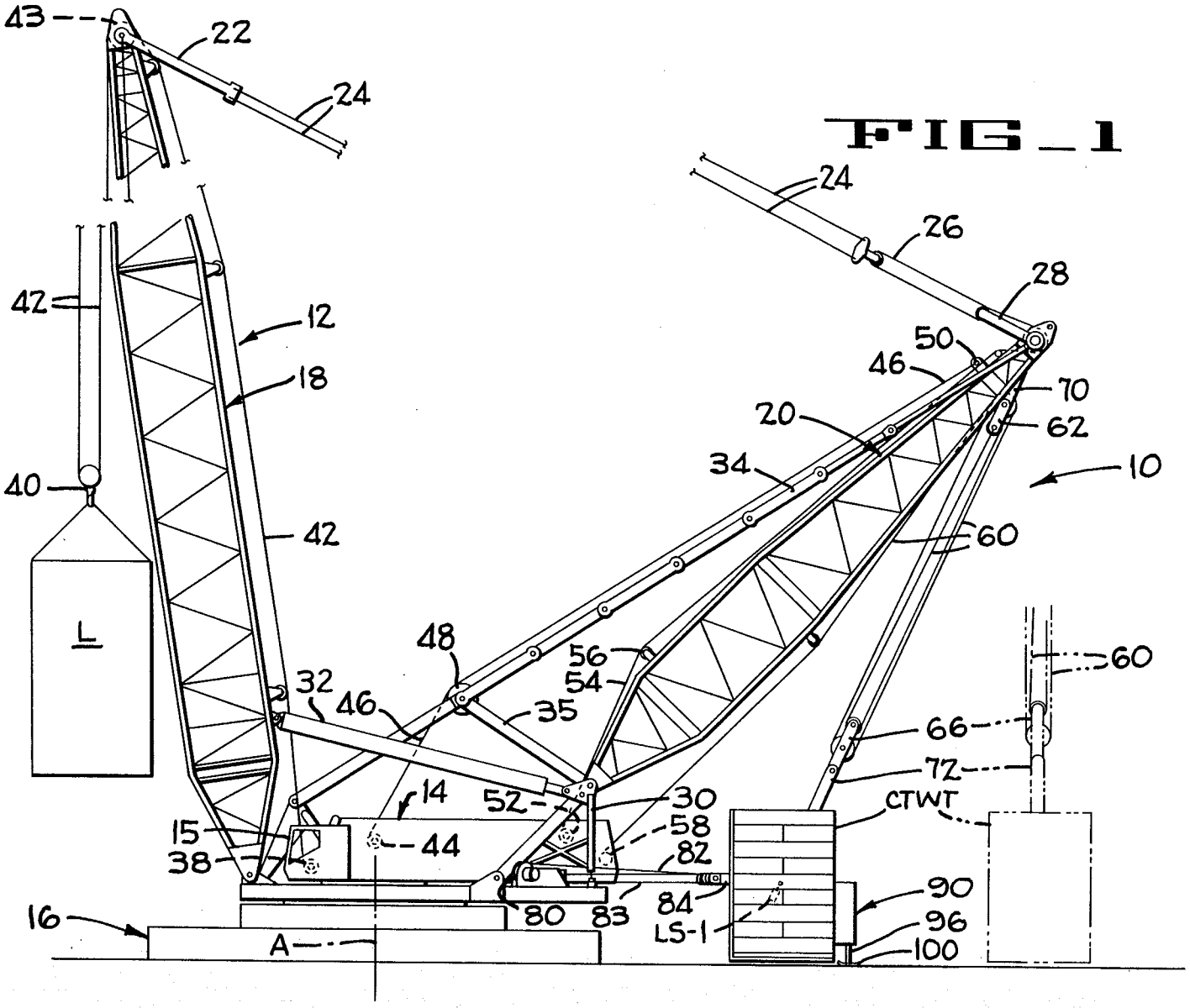
FIG. 1 is a diagrammatic side elevation of a travel crane illustrating the counterweight in two operative positions, certain parts being cut away.

The suspended counterweight control system 10 (FIG. 1) of the present invention is a component of a travel crane 12 which includes an upper works 14 that includes an operator's cab 15 and is pivotally supported by a lower works 16 for movement about a rotational axis A. The lower works 16 may be of any conventional type but is illustrated as a powered walking beam vehicle which is disclosed and claimed in assignee's Mick et al application Ser. No. 478,195 entitled Steerable Carrousel Supported Walking Beam Vehicle, which application which issued on May 28, 1985 as U.S. Pat. No. 4,519,468 and is incorporated by reference herein.

A boom 18 is pivotally supported on the upper works 14 and has its upper end connected to the upper end of a mast 20 by a pivotal link 22, pendant lines 24, a hoist 26 and a pivotal link 28. The lower end of the mast 20 is pivoted to the upper end of the mast foot frame 30 which is rigidly secured to the upper works 14. It is apparent that the boom 18 and mast are mounted for movement in a vertical plane containing the vertical rotational axis A (FIG. 1) and the longitudinal axis B (FIG. 2). A telescopic boom stop 32 is pivotally connected between the boom and the mast foot frame 30 and permits forward or counterclockwise pivotal movement (FIG. 1) but limits the rearward pivotal movement to the maximum boom elevation as illustrated in FIG. 1.

In order to maintain the mast 20 at a fixed angle relative to the upper works 14 during operation, a tension link 34 is connected between the mast pendant frame 35 and the top of the mast 20. Individual links in the tension link 34 may be removed, or additional links may be added, when it is determined that much lighter or much heavier loads will be carried by the crane. A load L suspended from the boom 18 will be balanced relative to the axis A by a counterweight CTWT.

Several winches are supported on the upper works and include a load hoist winch 38 connected to a load supporting hook block 40 by a load line 42 having multiple parts between the hook block 40 and the head sheaves 43 on the upper end of the boom 18. A mast hoist winch 44 has a mast hoist line 46 trained thereover, and around a sheave 48 journaled on the mast pendant frame 35 and is then anchored to the upper end portion of the mast at 50. The mast hoist winch 44 is provided for raising and lowering the mast. A boom hoist winch 52 has a boom hoist line 54 trained therearound, around sheaves 56 on the mast 20 (only one being shown), and has multiple parts of line which form a portion of the hoist 26. A counterweight hoist winch 58 has a counterweight hoist line 60 trained therearound. The line 60 is trained around an upper multiple sheave block 62, (FIG. 3) and around a lower multiple sheave block 66. The upper sheave block 62 is connected to a bracket 70 pivoted to the upper end of the mast 20, and the lower sheave block 66 is pivotally connected to a connecting link 72. The connecting link 72 is received in an opening 73 in the counterweight CTWT, and is connected to a rod 74 that is received in a slot 76 in the connecting link 72 and in the counterweight.

It will be understood that the term "line" as used in the specification and claims when referring to the several winches described above covers flexible tension members such as wire ropes.

Figure 5:
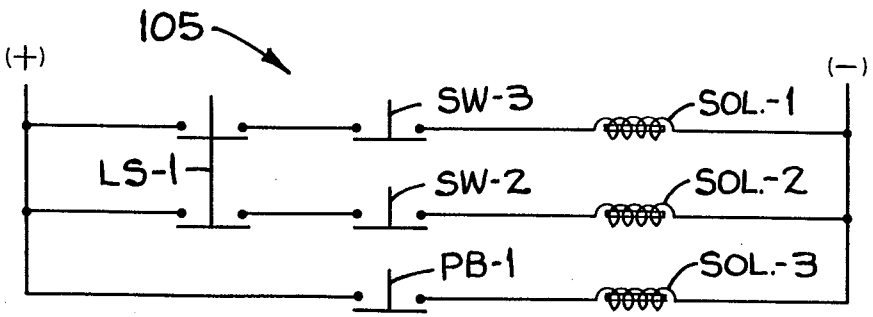
FIG. 5 is an electric diagram illustrating the electrical controls for the counterweight hoist winch motor.

When supporting the counterweight CTWT from the mast 20, the rod 74 engages the bottom of the slot 76 thereby closing a switch LS-1 (FIGS. 3 and 5). When the counterweight CTWT is resting on the ground and is not supported by the mast, the rod 74 engages the top of the slot 76 thus opening the switch LS-1.

As best shown in FIGS. 2 and 3, a pair of diagonal winches 80 and 80*a* are mounted on the upper works 14 on opposite sides of the longitudinal centerline or axis B of the upper works. Anti-swing counterweight lines 82 and 82*a* are trained around the winches 80,80*a* around hoists 83,83*a* and are anchored to the transverse midpoint of the counterweight at 84 for moving the counterweight toward and away from the centerline A of the crane 10.

As mentioned previously, it is desirable to maintain the height of the counterweight CTWT a few inches above the ground during operation. For this purpose, a height control mechanism 90 (FIG. 3) is provided. The height control mechanism 90 includes an upper guide bracket 92 and a lower guide bracket 94 secured to the counterweight CTWT. An opening is provided in each bracket for slidably receiving a switch activating bar 96 having an inclined intermediate portion 98 and a ground engaging member such as the illustrated annular shoe 100 (or a "dolly wheel") on its lower end with upturned edges for slidably engaging the ground. When the distance between the bottom of the counterweight and the ground is too great, the inclined portion 98 contacts and closes switch SW-2 thus providing a signal which will lower the counterweight CTWT. When the distance between the counterweight and the ground is too small, the inclined portion 98 contacts and closes a switch SW-3 thus providing a signal which will raise the counterweight CTWT. When in the illustrated position, both switches remain open indicating that the counterweight is at the desired height range above the ground, preferably about 4–6 inches.

A hydraulic circuit 104 (FIG. 4) for controlling the operation of the crane 10 is used in conjunction with the electrical circuit 105 of FIG. 5.

In operation, an engine E is started which drives a hydraulic pump P that directs high pressure fluid through line HP. Sump S provides a reservoir for fluid used throughout the hydraulic system. In the event the pressure should exceed a predetermined value, a pressure relief valve PRV is opened by high pressure in a pilot line 106 thereby returning the fluid directly to the sump S.

In order to drive the load hoist winch 38 the operator moves valve V1 into the cross passage "up" position or the parallel passage "down" position which drives the load hoist winch motor M1 in opposite directions. The mast 20 is erected and pivoted to different arcuate positions by the operator by shifting valve V2 to its "up" or "down" positions which drives the mast hoist winch motor M2 in opposite directions to raise or lower the mast 20. During operation, the mast is preferably retained in the position illustrated in FIG. 1 by the tension link 34. It will be understood, however, that the tension link 34 may be shortened or lengthened if the load moment relative to axis A is to be substantially reduced or increased, respectively, without changing the mass of the counterweight.

The boom 18 is pivoted about its axis when the operator actuates valve V3 into its "up" or "down" position which drives boom hoist winch motor M3 of the winch 52. The operator may actuate manual valve V4 into the "up" or "down" positions which drives the counterweight hoist motor M4 in directions to drive counterweight hoist winch 58 in opposite directions for raising or lowering the counterweight. In order to swing the upper works 14 about vertical axis A, the operator shifts manual valve V5 between its right and left positions thus driving the motor M5 to pivot the upper works in either direction relative to the lower works 16. The counterweight CTWT is moved between a rearward position directly below the top of the mast 20 as indicated in dotted lines in FIG. 1 to a forward position near the rear end of the upper works 14 as illustrated in solid lines by manually moving the valve V6 to its "forward" and "rearward" positions which simultaneously drives motors M6 and M6*a* of winches 80 and 80*a* (FIG. 2). The crane 12 is driven in a "forward" and "rearward" direction by shifting manual valve V7 which drives propulsion motor M7.

The operation of the crane 10 as thus far described is under the manual control of the operator. However, it is desirable to maintain the counterweight in the desired elevation range above the ground automatically during operation thereby relieving the operator of this function. Accordingly, solenoid valve V4′ (FIG. 4) is connected in parallel with valve V4 to the counterweight hoist winch motor M4. Also, a normally open solenoid operated shut-off valve V8 is provided in the supply and return lines from valve V4′ to the CTWT hoist winch motor M4. The shut-off valve V8 is closed and opened respectively, by actuating an overriding switch PB-1 (FIG. 5) located in the operator's cab 15 allowing the operator to manually override the valve V4′ of the counterweight height control system and to manually raise and lower the counterweight CTWT by manually actuating the valve V4.

When it is desired to manually maintain the counterweight in the desired elevation range, the operator closes switch PB-1 (FIG. 5) thereby energizing solenoid SOL-3 which shifts the valve V8 (FIG. 5) from its illustrated position to its passage blocking position. The operator then manually operates valve V4 to raise or lower the counterweight as previously described.

Figure 4:
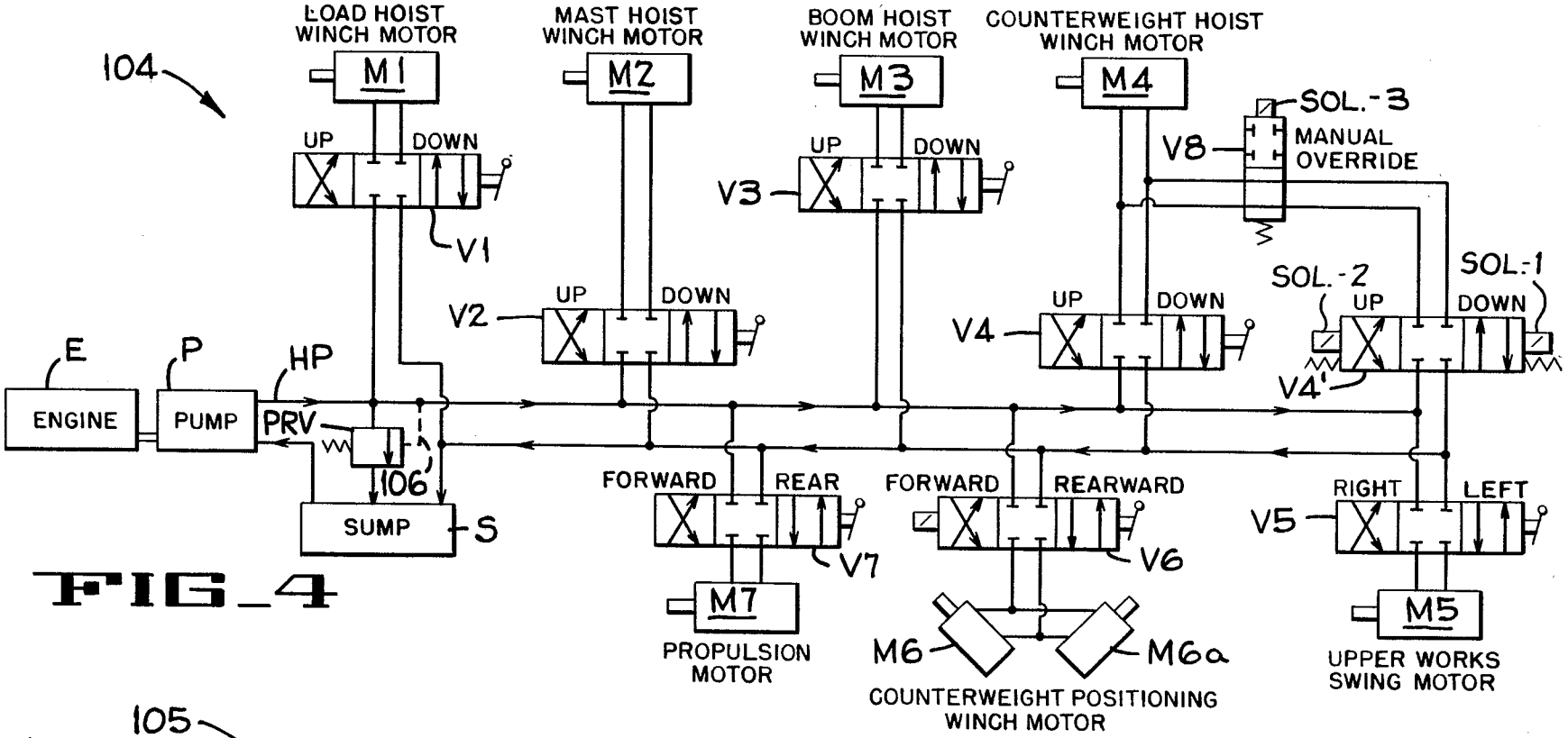
FIG. 4 is a hydraulic control circuit for the crane.

When it is desired to automatically maintain the counterweight at the desired elevation above the ground, the operator opens switch PB-1 thereby deenergizing solenoid SOL-3 and retaining valve V8 in its open position as illustrated in FIG. 4. Switch LS-1 (FIGS. 3 and 4) will be closed in response to the connecting link 72 supporting the counterweight. If the switches SW-2 and SW-3 (FIGS. 3 and 5) are not contacted by the intermediate portion 98 of the activating bar 96, the counterweight CTWT is within the desired range above the ground and accordingly solenoids SOL-1 and SOL-2 will not be energized and valve V4′ will remain in the illustrated closed position of FIG. 4. If the counterweight raises above the desired height range, switch SW-3 will be closed thereby energizing solenoid SOL-1 which will shift valve V4′ into the "down" position causing the counterweight hoist winch motor M4 to be driven in a direction which will lower counterweight CTWT until it returns to a position in the desired height range and thus opens both switches SW-2 and SW-3 (FIG. 3). If the counterweight is lowered below the desired height range, switch SW-2 ids closed by the activating bar 96, thus energizing solenoid SOL-2 which shifts the valve V4′ to its cross-passage "up" position thereby driving the counterweight hoist winch motor M4 which will raise the counterweight until it is again in its proper height range as illustrated in FIG. 3.

The previously described tension switch LS-1 (FIGS. 3 and 4) is closed in the circuit to solenoids SOL-1 and SOL-2 when tension is applied to the counterweight line 60 (FIGS. 1 and 3), and is opened when line 60 is slack, thus breaking the circuit to solenoids SOL-1 and SOL-2 allowing valve V4' to be spring urged into its illustrated closed position (FIG. 4).

The stabilizing meter SM (FIG. 3) detects the forward load moment which is the weight of the load L multiplied by the horizontal distance of the load L from the axis A; and also detects the counterweight moment which is the weight of the counterweight multiplied by the horizontal distance between the counterweight and the axis A. The stabilizing meter SM is located in the cab 15 and displays this stability information to the operator which indicates to the operator which direction the counterweight should be moved to maintain stability of the crane 10. If the two moments are not within a predetermined acceptable range indicated on the stabilizing meter SM, the operator determines from the meter whether the counterweight should be moved toward or away from the axis A, and shifts the manual valve V6 accordingly. Load cells within the stabilizing meter SM sense the crane imbalance and if the imbalance is severe, appropriate audio and visual devices (not shown) may be activated to alert the operator that rated capacities are being exceeded.

The above type of load moment device may include a well known display unit located in the operator's cab 15 of the type manufactured by System Equipment, Inc., 3203A Preston Road, Pasadena, Texas 77505.

This display unit provides the primary interface between the warning system and the crane operator. The load on the hook 40 is display to the operator by a load meter which reads from 0 to 240,000 pounds and is marked in 2,000 pound increments. An "alert" load meter is also marked from 0 to 240,000 pounds in 2000 pound increments, and continuously shows the capacity of the crane for the current operating radius. The "alert" load will vary in relation to the crane capacity chart as the reach (operating radius) is changed. A "reach meter" is marked from 15 to 250 feet in 2 foot increments and displays the distance in feet along the ground (from the centerline of rotation to the center of load). The load and reach meters are accurate to within plus or minus 2% of the full scale value and the "alert" load reading is accurate to within plus or minus 5% of the full scale value over the full range. The unit also includes a warning light and a horn in addition to the system on-off switch and self-testing switches.

From the foregoing description it will be apparent that the crane of the present invention includes two spaced counterweight positioning winches which move the suspended counterweight toward or away from the axis of rotation of the upper works for maintaining balance of the load. The two spaced winches also maintain transverse, self-centering pulling forces on the counterweight thus minimizing the tendency of the counterweight to swing from side to side in response to the upper works being pivoted to a different location and then stopped. The crane also includes a counterweight height control system which includes ground contacting means and a control means which automatically maintains the counterweight a few inches above the ground, but the automatic controls may be overriden by the operator if a serious imbalance of the crane occurs, or when the operator intentionally lowers the counterweight to rest on the ground.

Although the best mode contemplated for carrying out the present invention has been herein shown and described, it will be apparent that modification and variation may be made without departing from what is regarded to be the subject matter of the invention.

What is claimed is:

1. An apparatus for maintaining the stability of a suspended counterweight and crane or the like which includes an upper works having a longitudinal axis lying in a vertical plane, a lower works, means for supporting said upper works on said lower works for pivotal movement about a vertical axis, a boom mounted for pivotal movement about a horizontal axis on the upper works, a load, a load line suspending said load from the boom, a mast mounted for pivotal movement about a second horizontal axis on said upper works, a counterweight, a counterweight hoist line suspending said counterweight from said mast, said suspended load and counterweight normally lying in said vertical plane, and means connecting the upper end of the mast to the upper end of the boom; the improvement which comprises:

means for pivoting the boom about its horizontal axis for varying the horizontal distance of the load from said vertical axis; and means for simultaneously applying equal substantially horizontal diagonal counterweight pulling forces from opposite sides of the longitudinal axis of the upper works for maintaining the suspended counterweight substantially centered on said longitudinal axis and for controlling movement of the counterweight a sufficient amount toward or away from said vertical axis for maintaining the load within an acceptable balance range, said counterweight being suspended above a crane supporting surface and said counterweight hoist line being angled inwardly and downwardly toward said vertical axis when the crane is in operation.

* * * * *